US011309653B2

(12) United States Patent
Kai

(10) Patent No.: US 11,309,653 B2
(45) Date of Patent: Apr. 19, 2022

(54) CONNECTOR AND TERMINAL FITTING THAT INCLUDE LOCKING PORTION AND RESTRICTING PIECE

(71) Applicant: SUMITOMO WIRING SYSTEMS, LTD., Mie (JP)

(72) Inventor: Kenkichi Kai, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/014,069

(22) Filed: Sep. 8, 2020

(65) Prior Publication Data

US 2021/0083417 A1 Mar. 18, 2021

(30) Foreign Application Priority Data

Sep. 17, 2019 (JP) ..... JP2019-168059

(51) Int. Cl.
*H01R 13/42* (2006.01)
*H01R 4/18* (2006.01)

(52) U.S. Cl.
CPC ..... *H01R 13/42* (2013.01); *H01R 4/184* (2013.01)

(58) Field of Classification Search
CPC ..... H01R 13/42; H01R 4/184
See application file for complete search history.

(56) References Cited

U.S. PATENT DOCUMENTS

| | | | | |
|---|---|---|---|---|
| 7,371,132 | B2 | 5/2008 | Tanaka | |
| 7,374,465 | B2 | 5/2008 | Tanaka | |
| 9,570,854 | B2 * | 2/2017 | Hashimoto | H01R 13/113 |
| 9,614,314 | B2 * | 4/2017 | Chikusa | H01R 43/22 |
| 10,069,233 | B2 * | 9/2018 | Goto | H01R 13/113 |
| 2006/0172596 | A1 * | 8/2006 | Noro | H01R 43/16 439/595 |
| 2014/0024242 | A1 | 1/2014 | Nagasaka et al. | |
| 2018/0083380 | A1 * | 3/2018 | Goto | H01R 24/20 |
| 2019/0044270 | A1 * | 2/2019 | Miyamura | H01R 13/4362 |
| 2021/0083417 | A1 * | 3/2021 | Kai | H01R 13/42 |

* cited by examiner

*Primary Examiner* — Abdullah A Riyami
*Assistant Examiner* — Nader J Alhawamdeh
(74) *Attorney, Agent, or Firm* — Abelman, Frayne & Schwab

(57) ABSTRACT

A connector is provided with a housing 60 including a cavity 62 and a terminal fitting 10 to be inserted into the cavity 62. The housing 60 includes a deflectable locking lance 64 projecting into the cavity 62. The terminal fitting 10 includes a locking portion 29 arranged to face the locking lance 64 in a direction to escape from the cavity 62 and a restricting piece 45 rising toward the locking portion 29. A tip of the restricting piece 45 in a rising direction is arranged to face the locking lance 64.

7 Claims, 4 Drawing Sheets

CONNECTOR AND TERMINAL FITTING THAT INCLUDE LOCKING PORTION AND RESTRICTING PIECE

CROSS-REFERENCE TO RELATED APPLICATIONS

This application is based on and claims priority from Japanese Patent Application No. 2019-168059, filed on Sep. 17, 2019, with the Japan Patent Office, the disclosure of which is incorporated herein in their entireties by reference.

TECHNICAL FIELD

The present disclosure relates to a connector and a terminal fitting.

BACKGROUND

A connector terminal (hereinafter, terminal fitting) described in Japanese Patent Laid-open Publication No. 2012-199069 is accommodated into a terminal accommodation chamber (hereinafter, cavity) of a connector housing. The connector housing includes a deflectable locking lance projecting into the cavity. The locking lance includes an engaging protrusion on a tip part. The terminal fitting includes a connecting portion in the form of a rectangular tube. The connecting portion includes an engaged opening open in a wall part. The engaging protrusion of the locking lance is inserted into the engaging opening of the connecting portion. In this way, the escape of the terminal fitting from the cavity is prevented. A connector with a terminal fitting of this type is also disclosed in Japanese Patent Laid-open Publication No. 2007-141509.

SUMMARY

In the above case, if a strong force is applied in a pull-out direction to the terminal fitting, the locking lance may be warped and deformed (including inversion) in a direction to insert the locking lance deep into the engaging opening. If the locking lance is warped and deformed, the entire tip part of the locking lance may enter the connecting portion. As a result, there is a problem that reliability in holding the terminal fitting in a retained state by the locking lance cannot be maintained.

Accordingly, it is aimed to provide a connector capable of ensuring reliability in holding a terminal fitting.

The present disclosure is directed to a connector with a housing including a cavity and a terminal fitting to be inserted into the cavity, wherein the housing includes a deflectable locking lance projecting into the cavity, and the terminal fitting includes a locking portion arranged to face the locking lance in a direction to escape from the cavity and a restricting piece rising toward the locking portion, and a tip of the restricting piece in a rising direction is arranged to face the locking lance.

According to the present disclosure, it is possible to provide a connector capable of ensuring reliability in holding a terminal fitting.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
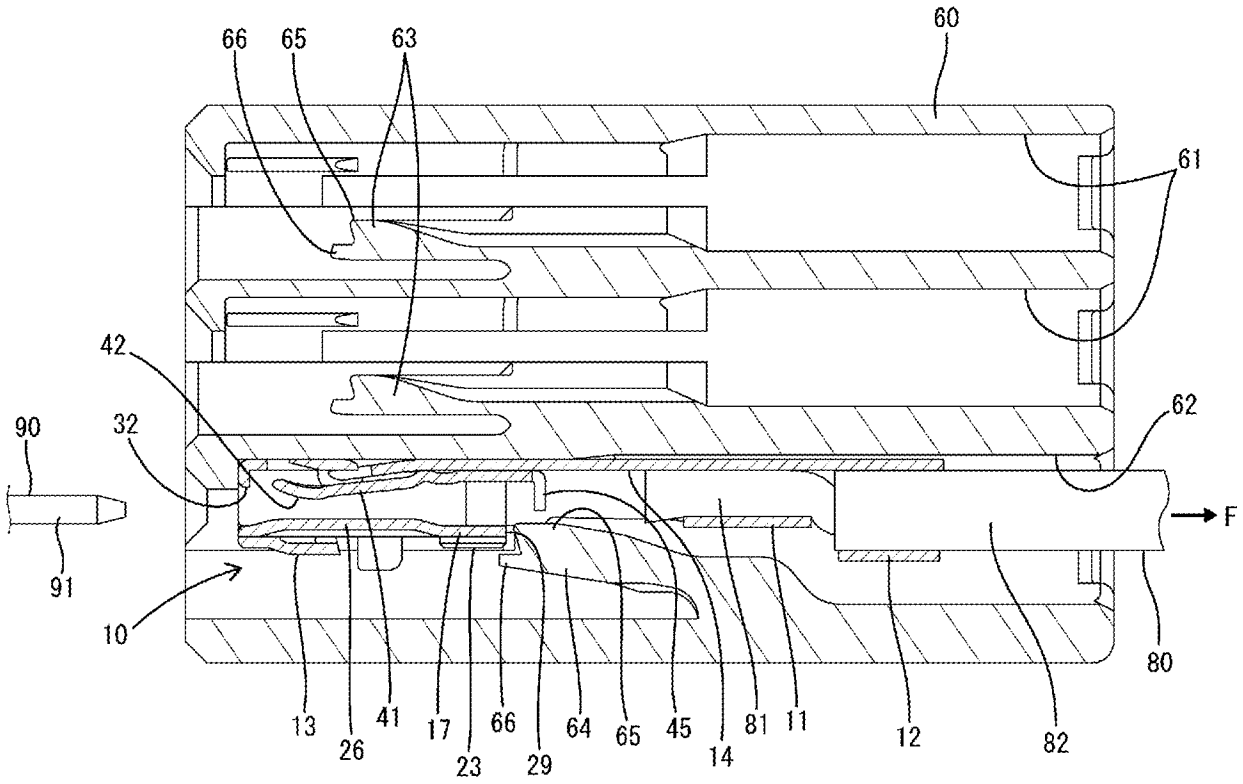
FIG. 1 is a section of a connector according to one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

[Description of Embodiments of Present Disclosure]

First, embodiments of the present disclosure are listed and described.

(1) The connector of the present disclosure is proved with a housing including a cavity and a terminal fitting to be inserted into the cavity, wherein the housing includes a deflectable locking lance projecting into the cavity, and the terminal fitting includes a locking portion arranged to face the locking lance in a direction to escape from the cavity and a restricting piece rising toward the locking portion, and a tip of the restricting piece in a rising direction is arranged to face the locking lance. According to this configuration, if a force such as a pull-out force is applied to the terminal fitting and the locking lance is going to be warped and deformed, the locking lance butts against the tip of the restricting piece in the rising direction. Thus, the locking lance is not excessively warped and deformed. As a result, reliability in holding the terminal fitting by the locking lance can be ensured. Particularly, since the tip of the restricting piece in the rising direction butts against the locking lance according to the above configuration, the toughness of the locking lance against butting can be maintained.

(2) Preferably, the terminal fitting includes a tubular box portion and a deflectable contact piece arranged inside the box portion, an opening in a front surface of the box portion serves as an insertion opening through which a tab of a mating terminal fitting is inserted, the contact piece contacts the tab, and the restricting piece is arranged behind the box portion to close an opening in a rear surface of the box portion. According to this configuration, an external matter trying to intrude into the box portion from behind can contact the restricting piece. As a result, the damage of the contact piece due to interference with the external matter can be avoided.

(3) The restricting piece may be formed by bending up a rear part of the contact piece. According to this configuration, an opening due to the formation of the restricting piece is not formed in an outer surface of the terminal fitting. As a result, the rigidity of the terminal fitting can be ensured.

(4) The contact piece may include a contact point portion in a central part in a plate width direction, and the restricting piece may be arranged at a position shifted from the central part of the contact piece in the plate width direction. According to this configuration, in inspecting a gap between the contact point portion of the contact piece and a wall surface facing the contact point portion, the presence of the restricting piece in an inspection path for inspection light such as laser light can be avoided. As a result, the gap can be properly inspected.

(5) A terminal fitting of the present disclosure is used in the connector described above. According to this configuration, it is possible to provide a terminal fitting ensured to be reliably held in the housing.

[Details of Embodiment of Present Disclosure]

A specific example of an embodiment of the present disclosure is described below with reference to the drawings. Note that the present invention is not limited to these illustrations and is intended to be represented by claims and include all changes in the scope of claims and in the meaning and scope of equivalents.

A connector includes a housing 60 made of synthetic resin and terminal fittings 10 made of metal. The terminal fittings 10 are accommodated into the housing 60. The housing 60 is connected to an unillustrated mating housing. The mating housing accommodates mating terminal fittings 90 inside. The mating terminal fitting 90 includes a tab 91. Note that, in the following description, a surface side where the housing 60 faces the mating housing at the start of connection is referred to as a front side concerning a front-rear direction.

<Housing 60>

The housing 60 is in the form of a rectangular block as a whole. As shown in FIG. 1, the housing 60 includes a plurality of cavities 61, 62 inside. Each cavity 61, 62 has an opening rectangular in cross-section and penetrates in the front-rear direction. The housing 60 includes locking lances 63, 64 projecting into the respective cavities 61, 62. The locking lance 63, 64 has a beam-like shape cantilevered obliquely to an upper-front side from the lower surface of an inner wall of the cavity 61, 62. The locking lance 63, 64 is deflectable and deformable in a vertical direction with a rear end side connected to the lower surface of the inner wall of the cavity 61, 62 as a fulcrum. The locking lance 63, 64 includes a projection 65 projecting upward. The locking lance 63, 64 includes a receiving piece 66 projecting on a tip (front end) while forming a step to the front surface of the projection 65.

Downward excessive deflection of the locking lance 63, 64 is restricted by the contact of a front end part of the locking lance 63, 64 with the lower surface of the inner wall of the cavity 61, 62. On the other hand, the locking lance 63, 64 is deflected and deformed upwardly, thereby entering deep into the cavity 61, 62 to be warped and deformed. In the case of this embodiment, warping deformation of the locking lance 64 is restricted by a restricting piece 45 to be described later.

In the case of this embodiment, an opening diameter of each cavity 61 in upper and middle stages is smaller than that of each cavity 62 in a lower stage. The locking lance 63 formed in each cavity 61 in the upper and middle stages is smaller in size than and disposed in front of the locking lance 64 formed in each cavity 62 in the lower stage.

<Terminal Fittings 10>

The terminal fitting 10 is formed, such as by bending one conductive plate material. The terminal fitting 10 is shaped to be elongated in the front-rear direction. A plurality of the terminal fittings 10 are prepared. The plurality of terminal fittings 10 are respectively inserted into the respective cavities 61, 62 of the housing 60 from behind.

As shown in FIG. 1, the terminal fitting 10 is connected to a front end part of a wire 80. The wire 80 includes a conductor portion 81 and a coating portion 82 surrounding the outer periphery of the conductor portion 81. The conductor portion 81 is, for example, constituted as a core made of a plurality of metal strands. The coating portion 82 is a coating made of insulating resin. The coating portion 82 is removed on the front end part of the wire 80. The conductor portion 81 is arranged to be exposed on the front end part of the wire 80.

The terminal fitting 10 includes a wire barrel portion 11 and an insulation barrel portion 12 in a rear part. The wire barrel portion 11 is in the form of an open barrel and crimped and connected to an exposed part of the conductor portion 81 of the wire 80. The insulation barrel portion 12 is in the form of an open barrel and arranged behind the wire barrel portion 11. The insulation barrel portion 12 is crimped and connected to the coating portion 82 of the wire 80. Note that the terminal fitting 10 is inserted into the cavity 61, 62 of the housing 60 in a posture vertically inverted from a posture shown in FIGS. 2, 4 and 5 (see FIG. 1). Thus, in the following description, the vertical direction is based on a state where the terminal fitting 10 is inserted in the cavity 61, 62 of the housing 60.

Figure 2:
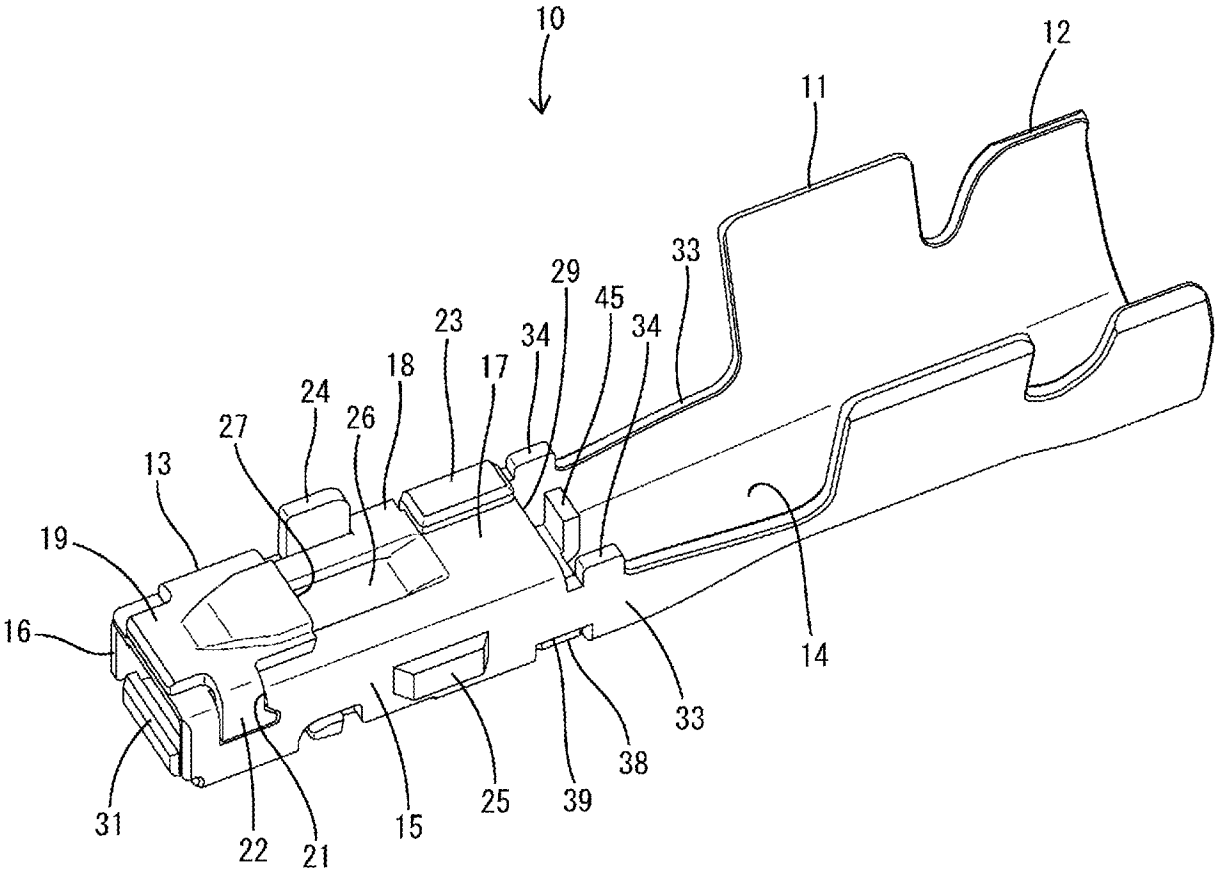
FIG. 2 is a perspective view of a terminal fitting.
Figure 5:
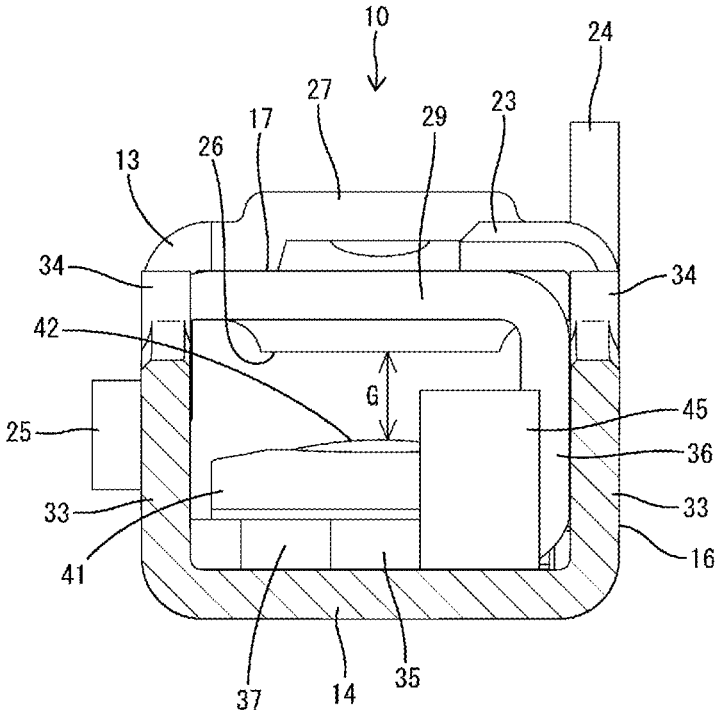
FIG. 5 is a section along B-B of FIG. 3.

The terminal fitting 10 includes a box portion 13 in a front part. As shown in FIGS. 2 and 5, the box portion 13 is formed into a tubular shape, particularly into a rectangular tubular shape. The box portion 13 includes a base wall 14, a pair of side walls 15, 16 projecting downward from both widthwise ends of the base wall 14, and a facing wall 17 extending from the lower end of one (hereinafter, referred to as a first side wall 15) of the both side walls 15, 16 toward the lower end of the other side wall (hereinafter, referred to as a second side wall 16). The facing wall 17 is arranged to face the base wall 14 from below. As shown in FIG. 2, the facing wall 17 includes a projecting piece 18 projecting from an end part in an extending direction. The projecting piece 18 is brought into contact with the lower end of the second side wall 16.

As shown in FIG. 2, the box portion 13 includes an outer wall 19 extending from a front part of the lower end of the second side wall 16 toward a front end of the lower end of the first side wall 15. The outer wall 19 is arranged to overlap a front part of the facing wall 17 from below. The outer wall 19 includes a locking piece 22 projecting from an end part in an extending direction. A locking recess 21 is open in the lower end of the front part of the first side wall 15. The locking piece 22 is bent toward the first side wall 15 and inserted into the locking recess 21. By locking the locking piece 22 to the first side wall 15, the outer wall 19 is fastened to the front part of the facing wall 17 and prevented from opening.

Further, the second side wall 16 includes a projecting piece 23 projecting from the lower end of a rear part. As shown in FIG. 2, the projecting piece 23 is bent toward the facing wall 17 and brought into contact with the lower surface of the facing wall 17. The rear end edge of the projecting piece 23 is arranged along a width direction. The rear end edge of the projecting piece 23 and that of the facing wall 17 are aligned at the same position in the front-rear direction.

As shown in FIG. 2, the second side wall 16 includes a stabilizer 24 in the form of a plate piece projecting downward in an intermediate part of the box portion 13 in the front-rear direction and between the outer wall 19 and the projecting piece 18. The first side wall 15 includes an embossed second stabilizer 25 bulging at a position near a center. The stabilizer 24 and the second stabilizer 25 function to guide an inserting operation of the terminal fitting 10 into the cavity 61, 62 and restrict inverted insertion of the terminal fitting 10 into the cavity 61, 62.

Figure 4:
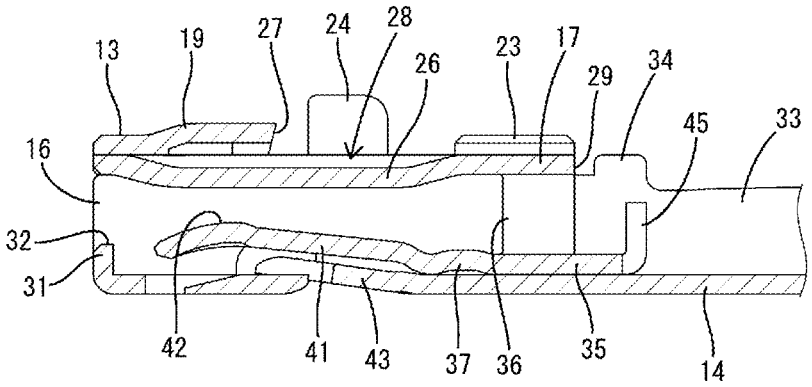
FIG. 4 is a section along A-A of FIG. 3.

The facing wall 17 includes a bead portion 26 bulging upward in a widthwise central part. As shown in FIG. 4, the bead portion 26 is shaped to extend in the front-rear direction. The bead portion 26 has a linear area along the front-rear direction in the box portion 13.

Further, a recess having the bead portion 26 as a bottom surface is formed in the lower surface of the facing wall 17. The outer wall 19 includes a locking protrusion 27 bulging downward in a widthwise central part of a rear end. As shown in FIG. 4, the box portion 13 includes a locking lance entrance allowing space 28 behind the locking protrusion 27 and below the bottom surface recess of the bead portion 26. The facing wall 17 includes a locking portion 29 on a rear end edge. As shown in FIGS. 2 and 5, the locking portion 29 is arranged along the width direction on the rear end edge of the facing wall 17. Further, the locking portion 29 includes the rear end edge of the projecting piece 23. Thus, the locking portion 29 is formed to have a double structure by the rear end edge of the projecting piece 23 and that of the facing wall 17 on one widthwise end side as shown in FIG. 4.

If the terminal fitting 10 is inserted into the cavity 62 in the lower stage, the projection 65 of the locking lance 64 in the lower stage is locked to the locking portion 29 of the terminal fitting 10 as shown in FIG. 1. On the other hand, if the terminal fitting 10 is inserted into the cavity 61 in the upper or middle stage, the projection 65 of the locking lance 63 in the upper or middle stage enters the locking lance entrance allowing space 28 and is locked to the locking protrusion 27 although not shown. In either case, the terminal fitting 10 is retained in the cavity 61, 62 by a locking action by the projection 65 of the locking lance 63, 64.

The base wall 14 is arranged over the entire length of the terminal fitting 10 while including the box portion 13. As shown in FIG. 4, the base wall 14 includes an end wall portion 31 projecting downward from a front end. An insertion opening 32 for the tab 91 is defined between the lower end of the end wall portion 31 and the front end of the facing wall 17 in the box portion 13.

As shown in FIGS. 2 and 5, the terminal fitting 10 includes a pair of coupling side walls 33 projecting downward from both widthwise ends of the base wall 14 between the box portion 13 and the wire barrel portion 11. The front ends of the pair of coupling side walls 33 are integrally connected to the both side walls 15, 16, and the rear ends thereof are integrally connected to both barrel pieces of the wire barrel portion 11.

The both coupling side walls 33 include a pair of guide walls 34 projecting downward at positions near the box portion 13 on lower ends. The both guide walls 34 are in the form of rectangular plate pieces and arranged behind the locking portion 29. The inner surfaces (plate surfaces) of the both guide walls 34 are arranged to face each other in parallel. The lower ends of the both guide walls 34 are arranged at the same height as the lower surface of the facing wall 17.

Figure 3:
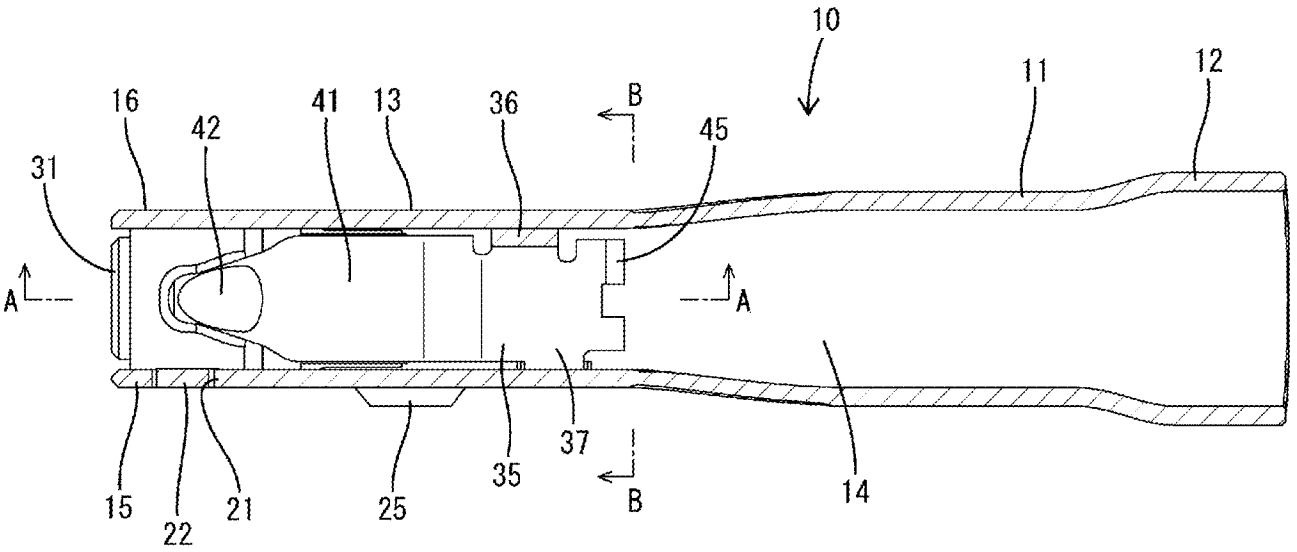
FIG. 3 is a plan view in section of the terminal fitting.

As shown in FIGS. 3 to 5, the terminal fitting 10 includes a contact piece 35 projecting into the box portion 13. Further, between a rear part of the contact piece 35 and a rear part of the facing wall 17, the terminal fitting 10 includes a linking portion 36 linking the respective rear parts. As shown in FIG. 5, the linking portion 36 intersects at a right angle with the respective rear parts of the facing wall 17 and the contact piece 35 and is arranged such that a plate surface extends along the vertical direction and is in contact with the inner surface of the second side wall 16.

The contact piece 35 includes a connecting body 37 in the form of a strip plate extending in the front-rear direction along the base wall 14. The upper end of the linking portion 36 is connected to one widthwise end of a rear part of the connecting body 37. The connecting body 37 includes a stopping portion 38 horizontally projecting in the width direction on the other widthwise end of the rear part as shown in FIG. 2. The first side wall 15 includes a stopping hole 39 elongated in the front-rear direction in the upper end of the rear part. The stopping portion 38 enters the stopping hole 39 of the first side wall 15 to be locked. The rear part of the connecting body 37 is fixed in contact with and along the inner surface (lower surface) of the base wall 14.

The connecting body 37 includes a resilient portion 41 on a side forward of the stopping portion 38. As shown in FIG. 4, the resilient portion 41 is in the form of a beam cantilevered obliquely to a lower-front side from the rear part of the connecting body 37. The resilient portion 41 includes a dome-shaped contact point portion 42 bulging to be closest to the bead portion 26 in a front part. As shown in FIG. 5, a top of the contact point portion 42 is located in a widthwise central part of the contact piece 35. The resilient portion 41 is deflectable and deformable with the rear part of the connecting body 37 as a fulcrum.

The tab 91 of the mating terminal fitting 90 is inserted into the box portion 13 through the insertion opening 32 (see FIG. 1). The tab 91 is sandwiched between the contact point portion 42 and the bead portion 26 while deflecting the resilient portion 41. In this way, the terminal fitting 10 and the mating terminal fitting 90 are electrically connected.

As shown in FIG. 4, the base wall 14 includes an auxiliary portion 43 formed by being bent downwardly. The auxiliary portion 43 is arranged to face a rear part of the resilient portion 41 from above on the base wall 14. The resilient portion 41 contacts the auxiliary portion 43 to be deflected and deformed together with the auxiliary portion 43. The auxiliary portion 43 reinforces a resilient reaction force of the resilient portion 41.

The contact piece 35 includes a rear end part exposed rearward from the rear end of the box portion 13. As shown in FIGS. 2 and 4, the contact piece 35 includes the restricting piece 45 in the rear end part. As shown in FIG. 5, the restricting piece 45 is in the form of a plate piece rectangular in a back view. The restricting piece 45 is formed by bending downwardly at a right angle a part projecting rearward from one widthwise end side (side where the linking portion 36 is located) of the rear end part of the contact piece 35. The restricting piece 45 is arranged along the vertical direction. The restricting piece 45 is arranged between the both guide walls 45 in the width direction. As shown in FIG. 5, the restricting piece 45 is arranged to cover an upper area on one widthwise side of an opening in the rear surface of the box portion 13 in a back view.

A base end of the restricting piece 45 is connected to the rear end of the connecting body 37. The connecting body 37 is arranged on an inner surface side of the base wall 14. Thus, the restricting piece 45 is also arranged without being exposed on an outer surface side of the base wall 14. An end edge (right edge in FIG. 5) on one widthwise side of the restricting piece 45 is arranged near the coupling side wall 33 connected to the second side wall 16 to face this coupling side wall 33 from an inner side. An end edge (left edge in FIG. 5) on the other widthwise side of the restricting piece 45 is arranged away from the inner surface of the coupling side wall 33 connected to the first side wall 15.

The lower end of the restricting piece 45 is arranged to be exposed downward. The lower end of the restricting piece 45 is formed along the width direction. A height of the restricting piece 45 is larger than half a distance between the inner surfaces of the base wall 14 and the facing wall 17 in the box portion 13. The lower end of the restricting piece 45 is located between the top of the contact point portion 42 and the upper surface of the bead portion 26.

The restricting piece 45 is shifted toward the one widthwise side from the top of the contact point portion 42 in the width direction.

One of management items of the terminal fitting 10 is an inspection as to whether or not a gap (G in FIG. 5) between the contact point portion 42 and the bead portion 26 is within a permissible range. In inspection, inspection light such as infrared laser light is irradiated to between the top of the contact point portion 42 and the bead portion 26. An irradiation or reflection direction of the inspection light is oriented in the front-rear direction. As described above, the restricting piece 45 is shifted in position in the width direction from the top of the contact point portion 42. Thus, the inspection light is not blocked by the restricting piece 45 and the gap between the contact point portion 42 and the bead portion 26 can be properly inspected.

<Assembling Structure of Terminal Fitting 10>

The terminal fitting 10 is inserted into the cavity 62 in the lower stage of the housing 60 from behind. In the process of inserting the terminal fitting 10, the projection 65 of the locking lance 64 slides on the outer wall 19 and the facing wall 17 of the box portion 13. In this way, the locking lance 64 is deflected and deformed downward. When the terminal fitting 10 is properly inserted, the locking lance 64 is displaced in a direction to resiliently return to an initial state (upward). In this way, the projection 65 of the locking lance 64 is arranged to face the locking portion 29 from behind as shown in FIG. 1. Further, the receiving piece 66 of the locking lance 64 is arranged to face the facing wall 17 and the projecting piece 23 from below. Note that the deflection of the locking lance 64 is guided by the both guide walls 34.

Thereafter, the housing 60 is connected to the mating housing. When the both housings are properly connected, the tab 91 of the mating terminal fitting 90 is properly inserted into the box portion 13. In this way, the both terminal fittings are electrically connected.

For example, if the wire 80 is pulled rearward with the terminal fitting 10 inserted in the cavity 62, a rearward pull-out force F (see FIG. 1) is applied to the terminal fitting 10. If the pull-out force F is excessive, the projection 65 of the locking lance 64 is strongly pressed rearward by the locking portion 29. In this case, the locking lance 64 is going to be displaced in an upward direction, which is a warping direction, with the lower surface of the inner wall of the cavity 62 as a fulcrum.

According to this embodiment, an upward displacement of the locking lance 64 is primarily restricted by the contact of the receiving piece 66 with the lower surface (facing wall 17, the projecting piece 23 and the like) of the box portion 13. Of course, if the pull-out force F, for example, becomes more excessive or is obliquely applied with respect to the front-rear direction, the receiving piece 66 may slip under the lower surface of the box portion 13 or may be cut.

If displacement restriction of the locking lance 64 by the receiving piece 66 no longer functions, the locking lance 64 is further displaced upward. Thereafter, the projection 65 of the locking lance 64 butts against the lower end of the restricting piece 45. In this way, the upward displacement of the locking lance 64 is secondarily restricted. The displacement of the locking lance 64 is restricted before exceeding a resiliency limit and the locking lance 64 is not deformed into an inverted shape.

An impact force due to the butting of the locking lance 64 is applied to the restricting piece 45. The restricting piece 45 rises in the vertical direction from a side facing the locking lance 64 (side where the locking portion 29 is located). The locking lance 64 is resiliently displaced along the vertical direction toward or away from the restricting piece 45. Thus, the impact force applied to the restricting piece 45 can be distributed over the entire length of the restricting piece 45. Therefore, a local concentration of stress on the restricting piece 45 can be avoided. As a result, the deformation of the restricting piece 45 can be prevented. Further, the upward displacement of the locking lance 64 is reliably hindered at a position where the projection 65 butts against the restricting piece 45.

As described above, since warping deformation of the locking lance 64 is restricted by the restricting piece 45 according to this embodiment, reliability in holding the terminal fitting 10 by the locking lance 64 can be ensured. Particularly, since the lower end (tip in a rising direction) of the restricting piece 45 contacts the locking lance 64, the toughness of the locking lance 64 against butting can be maintained.

Further, the restricting piece 45 is arranged behind the box portion 13 to close the opening in the rear surface of the box portion 13. Thus, an external matter from behind can contact the restricting piece 45 and the intrusion thereof into the box portion 13 can be prevented. As a result, the damage of the contact piece 35 due to interference with the external matter can be avoided.

Further, the restricting piece 45 is formed by bending up the rear part of the contact piece 35. Thus, an opening due to the formation of the restricting piece 45 is not formed in the outer surface of the terminal fitting 10. As a result, the rigidity of the terminal fitting 10 can be ensured.

Furthermore, the contact piece 35 includes the contact point portion 42 in the widthwise central part and the restricting piece 45 is arranged at the position shifted from the widthwise central part of the contact piece 35. Thus, in inspecting the gap between the contact point portion 42 and the bead portion 26, the presence of the restricting piece 45 in an inspection path for inspection light can be avoided. As a result, the gap can be properly inspected.

[Other Embodiments of Present Disclosure]

The embodiment disclosed this time should be considered to be illustrative rather than restrictive in all aspects.

Although the box portion 13, the wire barrel portion 11, the insulation barrel portion 12 and the contact piece 35 are integrally formed to the terminal fitting 10 as a whole in the case of the above embodiment, a box portion, a wire barrel portion and an insulation barrel portion may be integrally configured as a terminal body and a contact piece may be configured separately from the terminal body as another embodiment. In the case of the other embodiment, the contact piece may include fixing means to be positioned and fixed in the box portion of the terminal body.

Although the contact piece 35 is in the form of a beam cantilevered forward from the rear part of the box portion 13 in the case of the above embodiment, a contact piece may be cantilevered rearward from a front part of a box portion as another embodiment. Alternatively, a contact piece may be in the form of a beam supported on both ends in an extending direction coupled to a base wall.

Although the terminal fitting 10 is a female terminal fitting including the box portion 13, into which the tab 91 is inserted, in the case of the above embodiment, a terminal fitting may be a male terminal fitting including a tab projecting forward from a box portion as another embodiment.

Although the restricting piece 45 is formed by bending a part of the contact piece 35 in the case of the above embodiment, a restricting piece may be formed by bending a part of any one of a base wall, a facing wall, a first side wall and a second side wall as another embodiment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a housing including a cavity; and a terminal fitting to be inserted into the cavity, wherein:

the housing includes a deflectable locking lance projecting into the cavity, the terminal fitting includes:

a locking portion arranged to face the locking lance of the housing in a direction in which the terminal fitting escapes from the cavity; and a restricting piece rising from an upper wall of the terminal fitting toward a space behind the locking portion in a direction in which the terminal fitting is inserted into the cavity, and a tip of the restricting piece in a rising direction is arranged to face the locking lance of the housing.

2. The connector of claim 1, wherein the terminal fitting includes a tubular box portion and a deflectable contact piece arranged inside the box portion, an opening in a front surface of the box portion serves as an insertion opening through which a tab of a mating terminal fitting is inserted, the contact piece contacts the tab, and the restricting piece is arranged behind the box portion to close an opening in a rear surface of the box portion.

3. The connector of claim 2, wherein the restricting piece is formed by bending up a rear part of the contact piece.

4. The connector of claim 2, wherein the contact piece includes a contact point portion in a central part in a plate width direction, and the restricting piece is arranged at a position shifted from the central part of the contact piece in the plate width direction.

5. A terminal fitting used in a connector, wherein the connector comprises:

a housing including a cavity into which the terminal fitting is inserted, and a deflectable locking lance projecting into the cavity, wherein the terminal fitting comprises:

a locking portion arranged to face the locking lance of the housing in a direction in which the terminal fitting escapes from the cavity of the housing; and a restricting piece rising from an upper wall of the terminal fitting toward a space behind the locking portion in a direction in which the terminal fitting is inserted into the cavity of the housing, and wherein a tip of the restricting piece in a rising direction is arranged to face the locking lance of the housing.

6. The connector of claim 2, wherein the contact piece is provided on a lower surface of an upper wall of the tubular box portion in a state where the terminal fitting is inserted into the cavity.

7. The connector of claim 6, wherein the restricting piece is configured to rise from the contact piece toward the locking lance in a state where the terminal fitting is inserted into the cavity.

* * * * *